US008066520B2

(12) United States Patent
Lenfert et al.

(10) Patent No.: US 8,066,520 B2
(45) Date of Patent: Nov. 29, 2011

(54) SPARK PLUG TERMINAL CONNECTION APPARATUSES AND METHODS

(75) Inventors: Nathaniel Lenfert, Graham, NC (US); Yasushi Fujita, Chapel Hill, NC (US)

(73) Assignee: Honda Motor Co., Ltd., Tokyo (JP)

( * ) Notice: Subject to any disclaimer, the term of this patent is extended or adjusted under 35 U.S.C. 154(b) by 180 days.

(21) Appl. No.: 12/022,731

(22) Filed: Jan. 30, 2008

(65) Prior Publication Data

US 2008/0274632 A1 Nov. 6, 2008

Related U.S. Application Data

(60) Provisional application No. 60/926,996, filed on May 1, 2007.

(51) Int. Cl.
*H01R 13/44* (2006.01)

(52) U.S. Cl. ..... 439/125

(58) Field of Classification Search ..... 439/135, 439/34, 125; 123/634, 635
See application file for complete search history.

(56) References Cited

U.S. PATENT DOCUMENTS 1,933,304 A * 10/1933 Bell ..... 439/825
2,376,981 A 5/1945 Robinson
2,809,359 A 10/1957 Slick
3,354,419 A 11/1967 Miller, Jr.
3,431,534 A 3/1969 Schrader et al.
5,340,323 A 8/1994 Imanishi et al.
5,939,141 A 8/1999 Cagliostro
5,957,706 A 9/1999 Phillips, Jr. et al.
6,048,217 A 4/2000 Kobayashi
6,206,709 B1 3/2001 Uchiyama
6,247,943 B1 6/2001 Moga et al.
6,340,303 B2 1/2002 Hamada et al.
6,443,137 B1 9/2002 Kraft et al.
6,475,002 B2 11/2002 Delsole
6,668,810 B1 12/2003 St. John et al.

OTHER PUBLICATIONS

International Search Report and Written Opinion for PCT International Application No. PCT/US2008/001191 dated Jun. 26, 2008.

* cited by examiner

*Primary Examiner* — Briggitte R Hammond
(74) *Attorney, Agent, or Firm* — Jenkins, Wilson, Taylor & Hunt, P.A.

(57) ABSTRACT

Apparatuses and methods are provided for conductively connecting a voltage source ignition cable to a spark plug terminal. A spark plug boot assembly is provided and can include a body member, a coiled terminal, and a voltage source ignition cable. The coiled terminal can have a first end, a second end, and a middle portion and can include one or more coils that can extend to form an inner area with the coils having a varying inside diameter. The first end can be configured to receive a spark plug terminal. Also, the voltage source ignition cable can be configured to provide an additional electrical contact to the coiled terminal.

24 Claims, 9 Drawing Sheets

SPARK PLUG TERMINAL CONNECTION APPARATUSES AND METHODS

RELATED APPLICATIONS

The presently disclosed subject matter claims the benefit of U.S. Provisional Patent Application Ser. No. 60/926,996, filed May 1, 2007; the disclosure of which is incorporated herein by reference in its entirety.

TECHNICAL FIELD

The subject matter disclosed herein relates generally to apparatuses and methods for conductively connecting a voltage source ignition cable to a spark plug terminal for use with an internal combustion engine. More particularly, the present subject matter relates to providing spark plug terminal connection apparatuses and methods where a coiled terminal can be configured within a body member for conductively connecting a voltage source ignition cable to a spark plug terminal.

BACKGROUND

Various connector arrangements exist for connecting a voltage source to a spark plug for delivering a high voltage from the voltage source to the spark plug as needed to operate an internal combustion engine. Typical connector arrangements include an ignition terminal that is attached to an ignition cable that is connected to the voltage source. The ignition terminal mates with a spark plug terminal to provide a conductive connection. The ignition terminal is typically constructed using a stamping process in which one or more pieces of metal are stamp formed. The ignition terminal can be constructed from a spring steel with corrosion resistive properties such as stainless steel. The stamped ignition terminal can be expensive and complex to manufacture especially when more than one metal piece is used to construct the ignition terminal.

Another type of connector arrangement can include a spring or coiled ignition terminal. The coiled ignition terminal is shaped as a spring and has contacting points, usually two, extending away from the coiled ignition terminal and conductively contacting an ignition cable. One end of the coiled ignition terminal can receive a spark plug terminal. The coiled ignition terminal is often made of a primarily bronze material and is a single piece that is heat treated to give it spring-like performance properties. Advantageously, the coiled ignition terminal is generally cheaper and less complex to produce than the stamped ignition terminal.

Current connector arrangements with coiled ignition terminals, however, have many drawbacks. For example, the contacting points that connect the coiled ignition terminal to the ignition cable must have ends that pierce the insulation of the ignition cable and that pass through the core wire of the ignition cable. This vital connection is controlled by a manufacturing process and/or by an assembly worker, which can lead to contacts having poor quality and performance. Furthermore, conventional coiled ignition terminals do not provide a user with a click sound or detent feel that a user normally hears and feels when attaching the connector arrangement to the spark plug terminal. Rather, these coiled ignition terminals fit over the spark plug terminal with a constant interference fit.

Therefore, it would advantageous to employ a connector arrangement having a coiled ignition terminal that can be configured to provide a clicking sound and/or detent feel when attached to a spark plug terminal. The connector arrangement can also provide an additional contact point for improving conductivity by extending the core wire of an ignition cable beyond the insulation layer of the ignition cable such that the outer surface of the core wire can conductively contact the coiled ignition terminal to ensure electrical contact potential and quality.

SUMMARY

According to the present disclosure, novel spark plug terminal connection apparatuses and methods are provided for conductively connecting a spark plug terminal to an ignition wire for use with an internal combustion engine.

It is therefore an object of the present disclosure to provide spark plug terminal connection apparatuses and methods for conductively connecting a spark plug terminal to an ignition wire for use with an internal combustion engine. An object having been stated above, and which is achieved in whole or in part by the subject matter disclosed herein, other objects will become evident as the description proceeds when taken in connection with the accompanying drawings as best described hereinbelow.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

DETAILED DESCRIPTION

Reference will now be made in this detail description of aspects of the present disclosure, one or more examples of which are shown in the figures. Each example is provided to explain the subject matter and not as a limitation. In fact, features illustrated or described as part of one embodiment can be used in another embodiment to yield still a further embodiment. It is intended that the present subject matter cover such modifications and variations.

Figure 1:
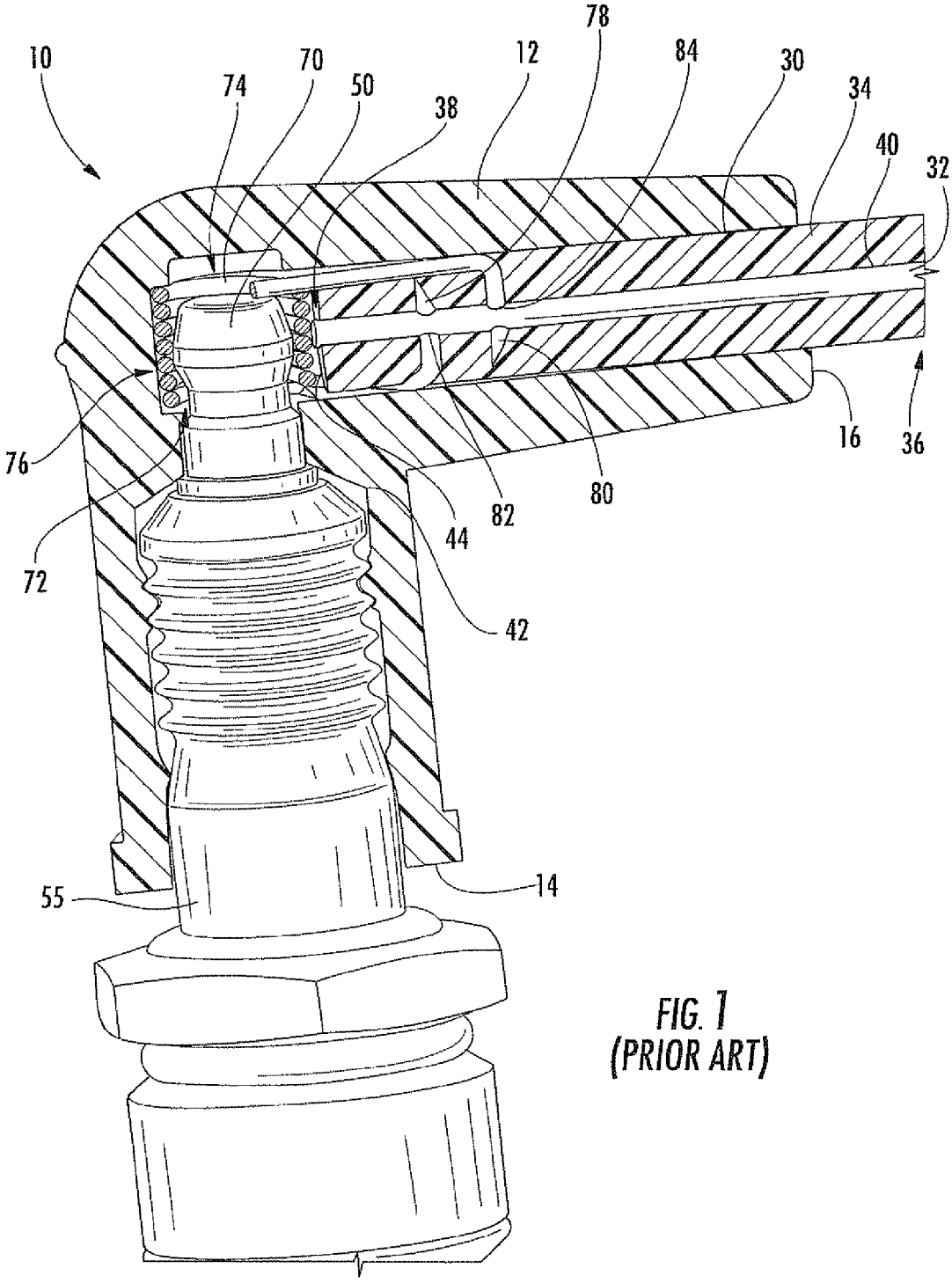
FIG. 1 (PRIOR ART)
FIG. 1 illustrates a cross-sectional side view of a prior art coiled terminal for connecting an ignition wire to a spark plug terminal.

Referring now to FIG. 1, a prior art spark plug boot assembly generally designated 10 for conductively connecting a voltage source ignition cable 30 to a spark plug terminal 50 of a spark plug 55 for use with an internal combustion engine (not shown) is illustrated by way of example. Spark plug boot assembly 10 includes a body member 12 having a first end 14 for receiving spark plug terminal 50 and a second end 16 for receiving voltage source ignition cable 30. Body member 12 is generally L-shaped.

A coiled terminal 70 is positioned within body member 12. Coiled terminal 70 includes a first end generally designated 72, a second end generally designated 74, and a middle portion generally designated 76. Coiled terminal 70 is a single wire material wound in a spring-like manner where a first tip 78 and a second tip 80 form the ends of the wire material. Coiled terminal 70 is of the straight coil type in which the inside diameter of coiled terminal 70 is adapted to fit onto spark plug terminal 50 with a constant interference fit and remains constant from first end 72 to second end 74 with no varying diameter. First tip 78 extends from first end 72 of coiled terminal 70 to form first conductive contact portion 82 for contacting voltage source ignition cable 30. Second tip 80 extends from second end 74 of coiled terminal 70 to form second conductive contact portion 84 for contacting ignition cable 30. First end 72 of coiled terminal 70 receives spark plug terminal 50.

Voltage source ignition cable 30 includes a conductive wire 32 and an insulation layer 34. Voltage source ignition cable 30 has a first end generally designated 36 connected to a voltage source (not shown) and a second end generally designated 38 received within second end 16 of body member 12. Conductive wire 32 has an outer surface 40 that is covered by insulation layer 34. First tip 78 and second tip 80 pierce conductive wire 32 such that first conductive contact portion 82 and second conductive contact portion 84 contact conductive wire 32. A first end 42 of conductive wire 32 terminates at substantially the same position as a first end 44 of insulation layer 34.

The configuration of prior art spark plug boot assembly 10 as shown in FIG. 1 is deficient in a number of ways. Connecting first and second conductive contact portions 82, 84 to conductive wire 32 to form a stable and quality contact is critical to the performance of spark plug boot assembly 10. This critical connection is controlled by a manufacturing process and/or by an assembly worker, which can lead to connections lacking high electrical contact potential and quality. Also, because first end 42 of conductive wire 32 terminates at substantially the same position as first end 44 of insulation layer 34, first end 42 of conductive wire 32 may or may not contact coiled terminal 70 to provide another quality electrical contact. Certainly, outer surface 40 of conductive wire 32 will not contact coiled terminal 70.

Furthermore, the conventional configuration of spark plug boot assembly 10 as illustrated in FIG. 1 is deficient because it fails to provide a click or detent mechanism to assure a user that the spark plug boot assembly 10 has been properly and satisfactorily attached to spark plug terminal 50 to form a good electrical contact. Prior art spark plug boot assembly 10 uses coiled terminal 70 of a straight coil type where the insider diameter is constant from first end 72 to second end 74 such that coiled terminal 70 loosely fits around spark plug terminal 50. This configuration fails to assure the user that spark plug boot assembly 10 is soundly attached to spark plug terminal 50.

Referring now to FIGS. 2-6 depicting the present disclosure, a spark plug boot assembly generally designated 110 for conductively connecting a voltage source ignition cable 130 to a spark plug terminal 150 of a spark plug 155 for use with an internal combustion engine (not shown) in accordance with the present disclosure is illustrated by way of example. In one aspect, spark plug boot assembly 110 can include a body member 112 having a first end 114 for receiving spark plug terminal 150 and a second end 116 for receiving voltage source ignition cable 130. Body member 112 can be generally L-shaped or any other suitable shape and size. Body member 112 can be constructed of any suitable material, such as for example a silicon based material, for providing heat and/or electrical resistance.

A coiled terminal 170 can be housed and positioned within body member 112. Body member 112 can thus provide protection from the elements that can damage spark plug 155 when in use. For example, spark plug boot assembly 110 can be used in lawnmower applications where coiled terminal 170 would be exposed to the elements but for body member 112. Furthermore, body member 112 can protect users from directly contacting coiled terminal 170 when in use that could result in an injurious shock. Coiled terminal 170 can serve as an electrical contact between a voltage source (not shown) and spark plug terminal 150.

In accordance with the present disclosure, coiled terminal 170 can provide a variable interference fit with a spark plug terminal such as spark plug 150. In one aspect, coiled terminal 170 can include a first end 172, a second end 174, and a middle portion generally designated 176. Coiled terminal 170 can be a single wire material wound in a spring-like manner where a first tip 178 and a second tip 180 form the ends of the wire material. This structure is simple and has a simple manufacturing process that lowers manufacturing costs. First tip 178 can extend from first end 172 of coiled terminal 170 to form first conductive contact portion 182 for contacting voltage source ignition cable 130. Second tip 180 can extend from second end 174 of coiled terminal 170 to form second conductive contact portion 184 for contacting ignition cable 130. First end 172 of coiled terminal 170 can be adapted to receive spark plug terminal 150. Coiled terminal 170 can be constructed, at least primarily, of a stainless steel material or of any other suitable material, such as bronze for example. Also, coiled terminal 170 can be heat treated to have spring-like performance characteristics.

In one aspect, coiled terminal 170 can be configured to securely attach to spark plug terminal 150 and provide a clicking sound and/or detent feel to ensure a proper connection between coiled terminal 170 and spark plug terminal 150 by assuring the user of the attachment therebetween. Rather than coiled terminal 170 being of the straight coil type in which the inside diameter of coiled terminal 170 remains constant from first end 172 to second end 174, the diameters of certain portions of coiled terminal 170 can be varied to provide a clicking sound and/or detent feel.

Figure 2:
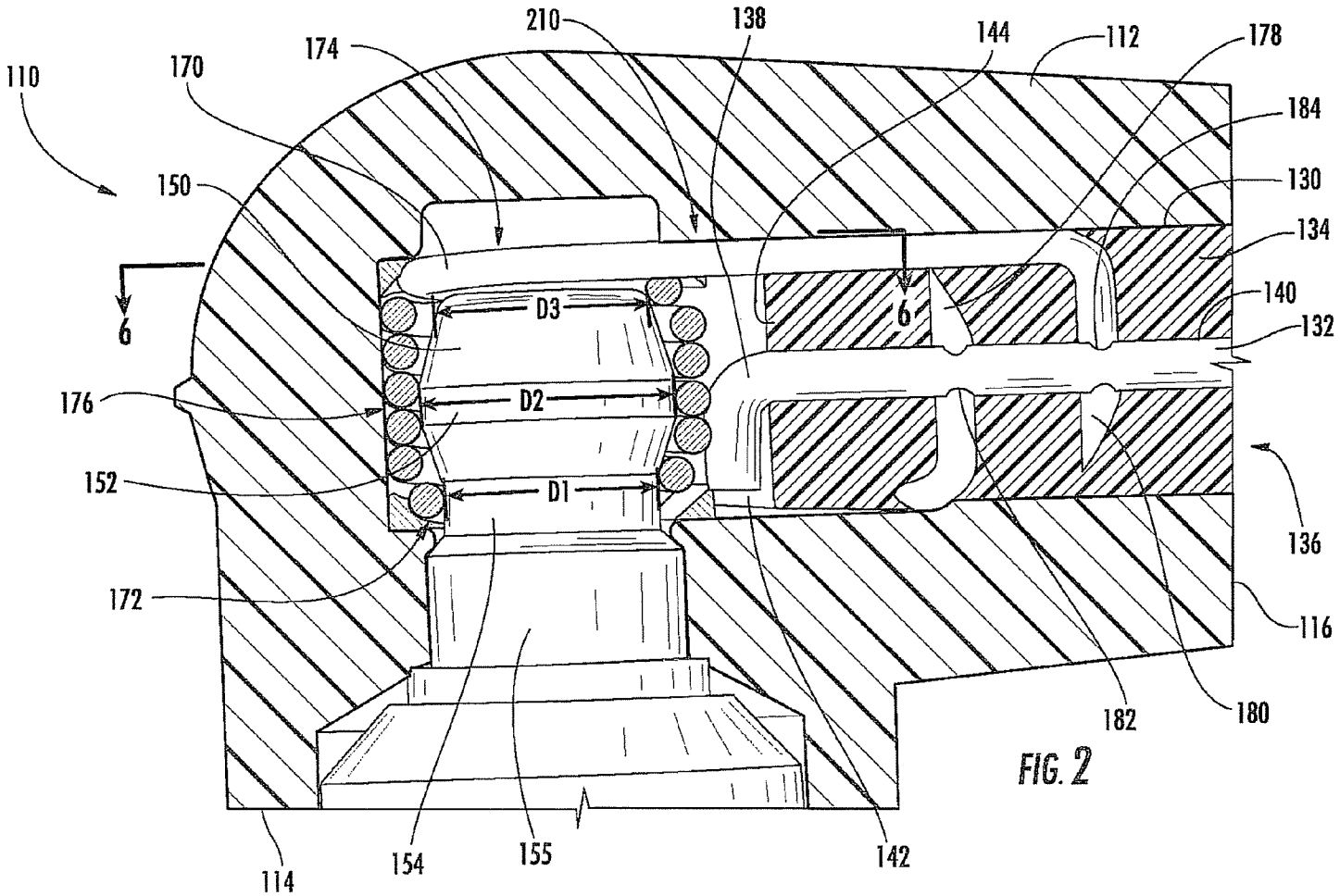
FIG. 2 illustrates a cross-sectional side view of an embodiment of a spark plug boot assembly having a coiled terminal attachable to a spark plug terminal according to the present subject matter.
Figure 3:
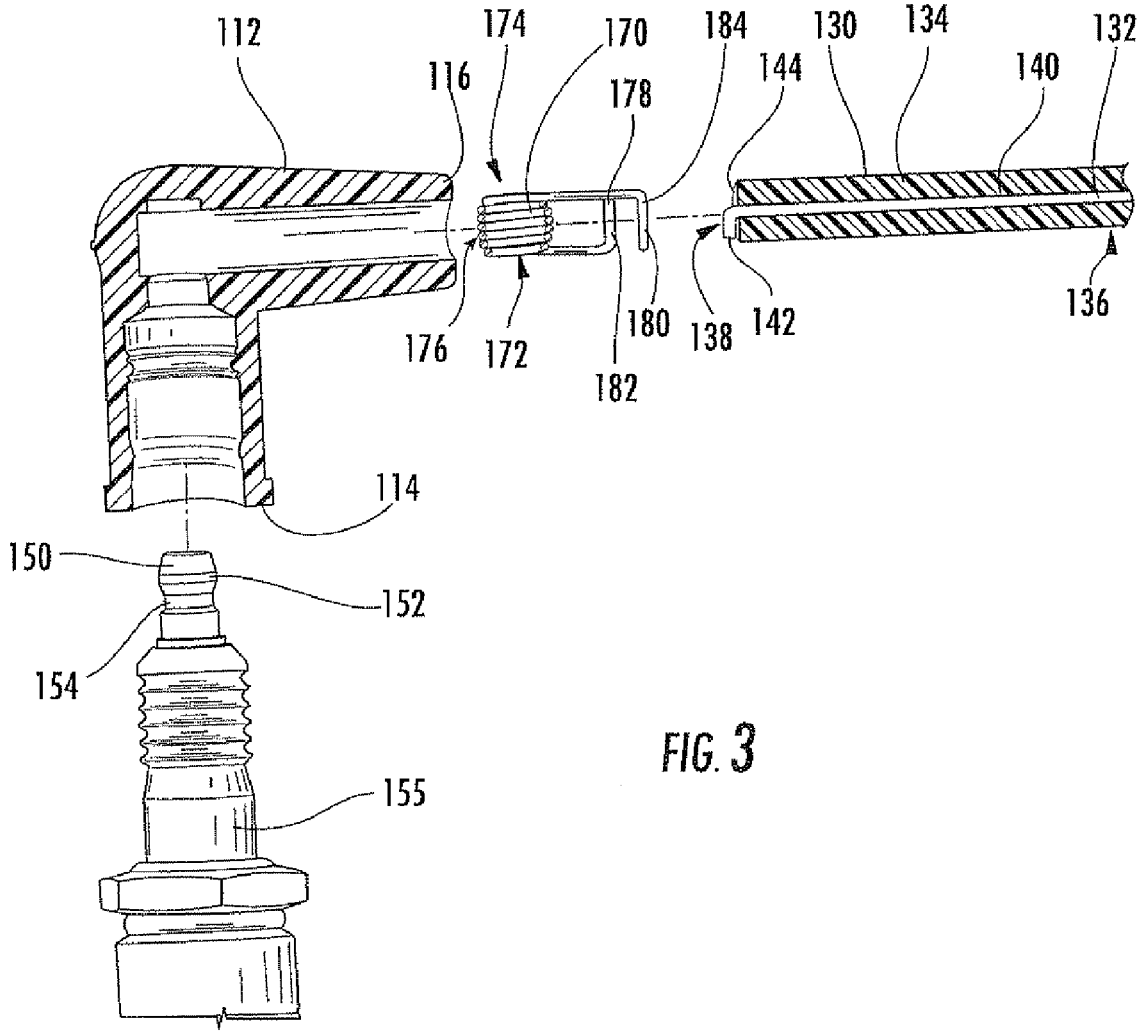
FIG. 3 illustrates an exploded partial cross-sectional side view of the spark plug boot assembly according to FIG. 2.
Figure 4:
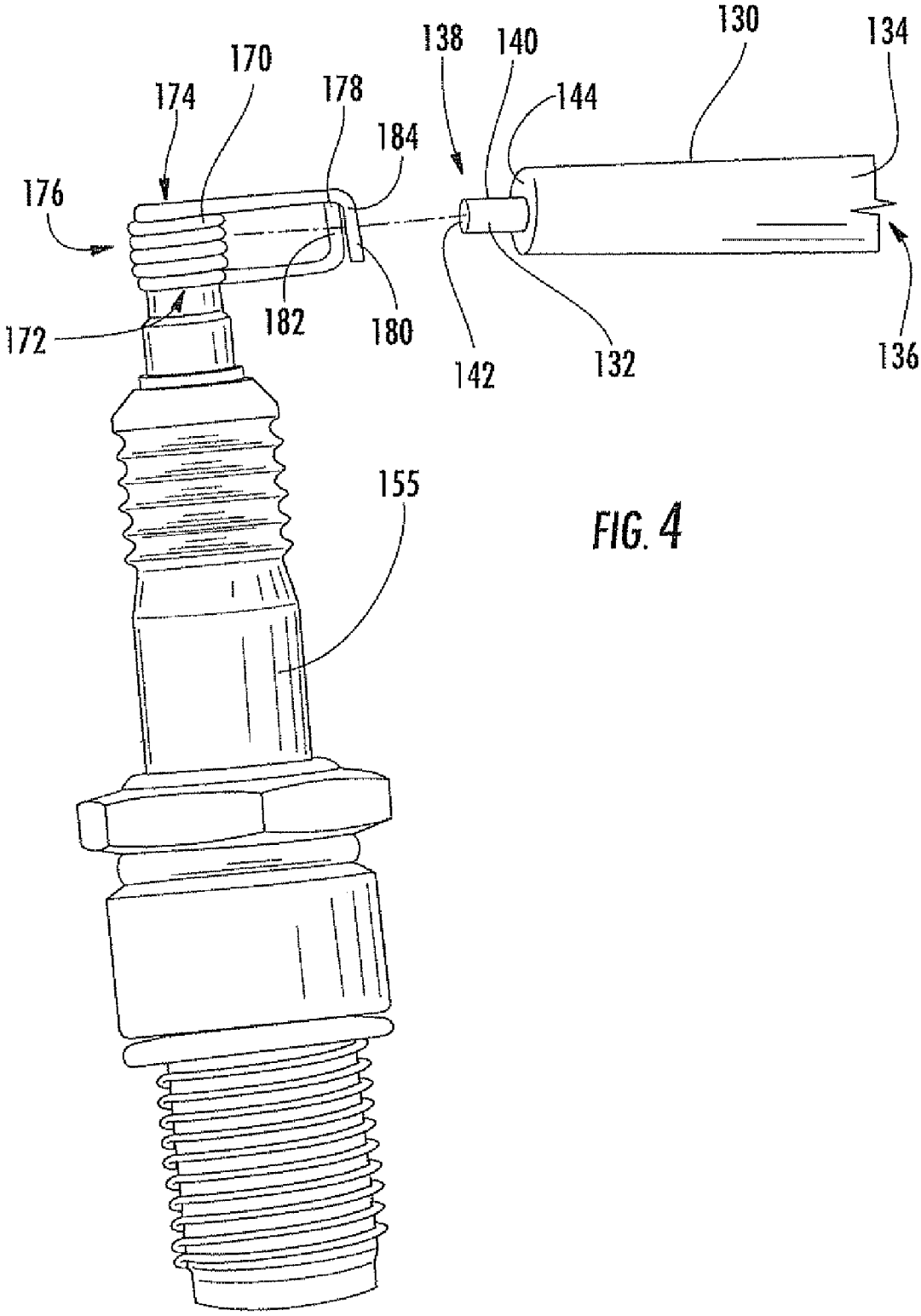
FIG. 4 illustrates an exploded side view of an embodiment of a coiled terminal securely connected to a spark plug terminal and with a conductive wire of an ignition cable according to the present subject matter.

First end 172 of coiled terminal 170 can have a diameter D1 that can be smaller than a diameter D2 of middle portion 176 of coiled terminal 170, as shown in FIG. 2. When receiving spark plug terminal 150, first end 172 can elastically deform to permit spark plug terminal 150 to completely pass into coiled terminal 170 to accommodate the standard configuration of spark plug terminal 150. The standard configuration of spark plug terminal 150 can include a wide portion 152 and a narrow portion 154, as illustrated in FIGS. 2-4. First end 172 of coiled terminal 170 can be smaller than wide portion 152 of spark plug terminal 150. After wide portion 152 of spark plug terminal 150 passes through first end 172, first end 172 can snuggly fit around narrow portion 154 of spark plug terminal 150 to form a secure connection.

Figure 6:
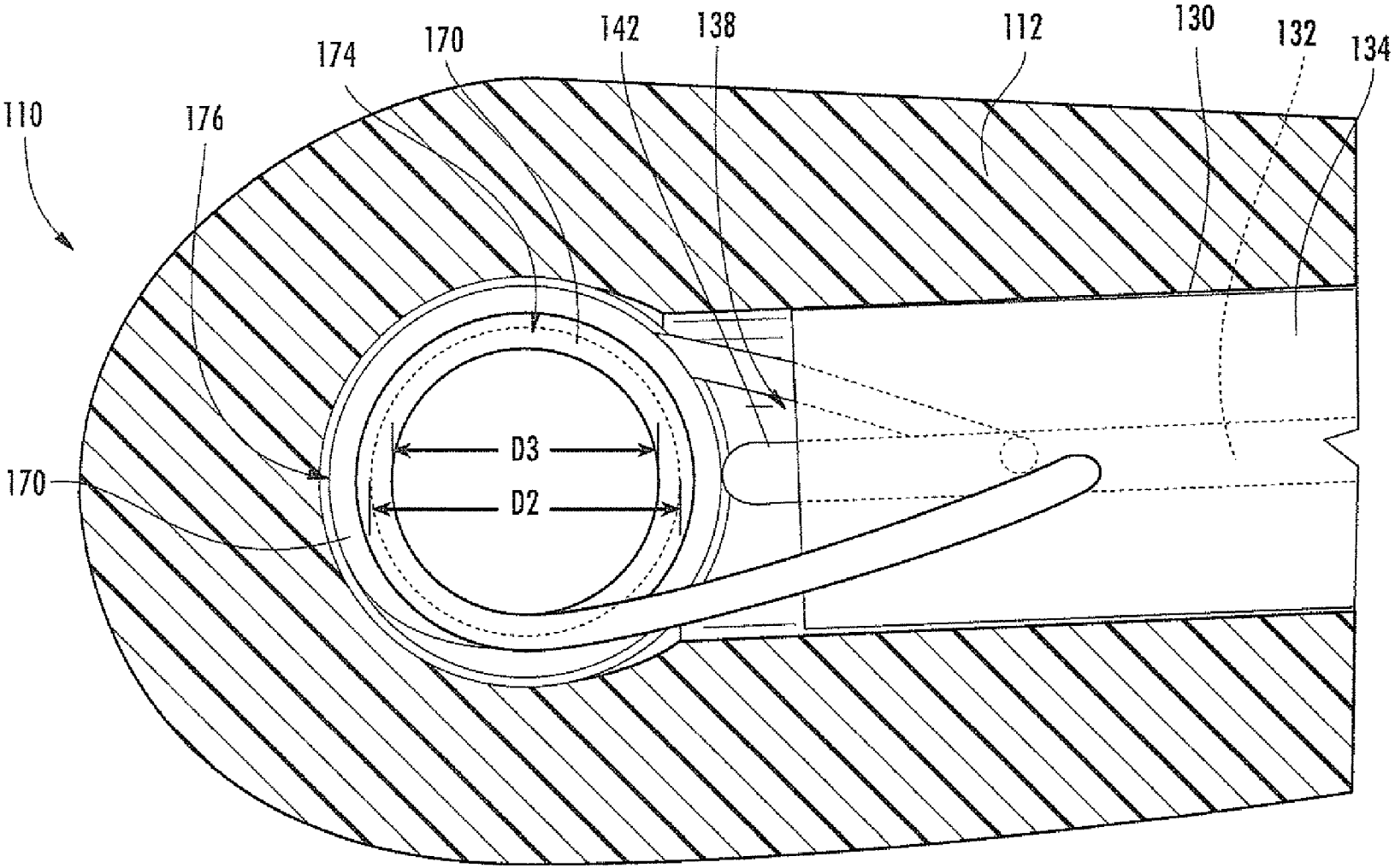
FIG. 6 illustrates a cross-sectional plan view of the spark plug boot assembly according to FIG. 2.

In another aspect, second end 174 can have a diameter D3 that can be smaller that diameter D2 of middle portion 176 of coiled terminal 170, as shown in FIGS. 2 and 6. When spark plug terminal 150 passes through coiled terminal 170 a top portion 156 of spark plug terminal 150 can be fittingly engaged in second end 174 of coiled terminal 170. The elasticity and spring-like properties of coiled terminal 170 permit this fitting engagement. This can provide a clicking sound or detent feel to assure the user that the connection between spark plug terminal 150 and coiled terminal 170 has been properly made.

In yet another aspect, first end 172 and second end 174 can each have smaller diameters than the diameter of middle portion 176, wherein diameter D1 of first end 172 and diameter D3 of second end 174 can both be smaller than diameter D2 of middle portion 176, as shown in FIG. 2. In such a configuration, first end 172 and second end 174 both provide secure engagement of coiled terminal 170 to spark plug terminal 150. Furthermore, this configuration can provide the clicking sound and/or detent feel that assures the user that a secure connection has been made.

Voltage source ignition cable 130 can include a conductive wire 132 and an insulation layer 134. Voltage source ignition cable 130 can have a first end 136 connected to a voltage source (not shown). The voltage source can be an ignition coil or a magneto when used in lawnmower applications. Voltage source ignition cable 130 can carry the high voltage from the voltage source to spark plug terminal 150.

Figure 5:
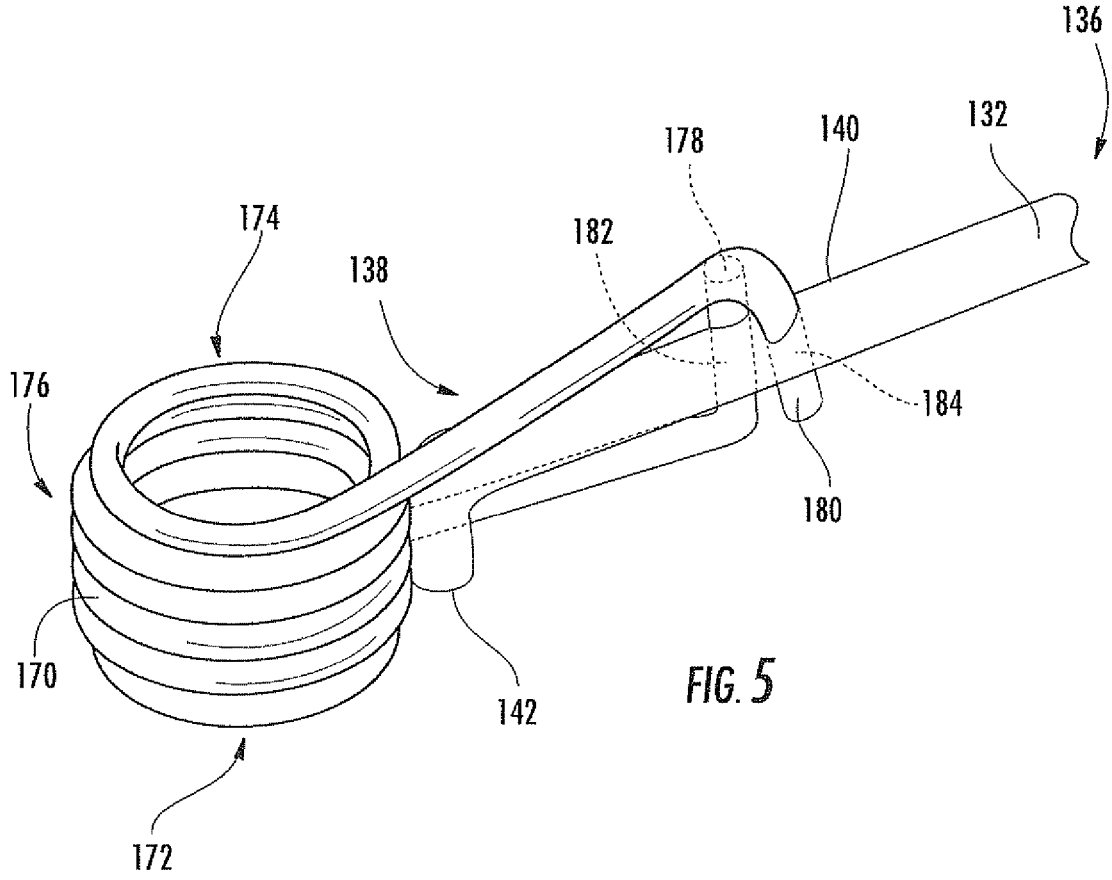
FIG. 5 illustrates a perspective view of an embodiment of a coiled terminal conductively connected with a conductive wire of an ignition cable according to the present subject matter.

The voltage source ignition cable 130 can have a second end 138 that can be received within second end 116 of body member 112. Conductive wire 132 has an outer surface 140 that can be covered by insulation layer 134. First tip 178 and second tip 180 of coiled terminal 170 can pierce conductive wire 132 such that first conductive contact portion 182 and second conductive contact portion 184 physically and electrically contact conductive wire 132 to form an electrical connector system generally designated 210, as shown in FIGS. 2 and 5. Conductive wire 132 can be constructed of any conductive material suitable for the application for which it is needed. Insulation layer 134 can be constructed of any material suitable for providing the requisite insulation to the application for which it is needed.

In one aspect, conductive wire 132 can be used with spark plug boot assembly 110 as an electrical contact to improve electrical contact potential and quality of the connection between the voltage source and spark plug 155. A first end 142 of conductive wire 132 can extend beyond a first end 144 of insulation layer 134. First end 142 of conductive wire 132 can bend such that outer surface 140 contacts coiled terminal 170 as an addition electrical contact. This configuration can provide a larger contact area between conductive wire 132 and coiled terminal 170 as opposed to merely having first end 142 of conductive wire 132 abut coiled terminal 170. Thus, this configuration can ensure a more dependable and quality electrical contact. As shown in FIGS. 2 and 5, this configuration can provide three points of contact in which first conductive contact portion 182, second conductive contact portion 184, and outer surface 140 of first end 142 of conductive wire 132 each form an electrical contact to carry high voltage from the voltage source to spark plug 155 for facilitating use of an internal combustion engine.

In one aspect, spark plug boot assembly 110 can include the three point electrical contact configuration described above in combination with coiled terminal 170 as also described above in accordance with the present disclosure where first end 172 and/or second end 174 of coiled terminal 170 have diameters that are smaller than middle portion 176 of coiled terminal 170. Thus, the combination can provide an additional electrical contact as well as a clicking sound and/or detent feel to assure the user that coiled terminal 170 has been securely attached to spark plug terminal 150.

In another aspect, spark plug boot assembly 110 can include the three point electrical contact configuration described above in combination with prior art coiled terminal 70, as shown in FIG. 1. Thus, coiled terminal 70 can be of a straight coil type in which the diameter remains constant over the length of coiled terminal 70, thereby providing an additional electrical contact to known terminal structures.

Figure 7A:
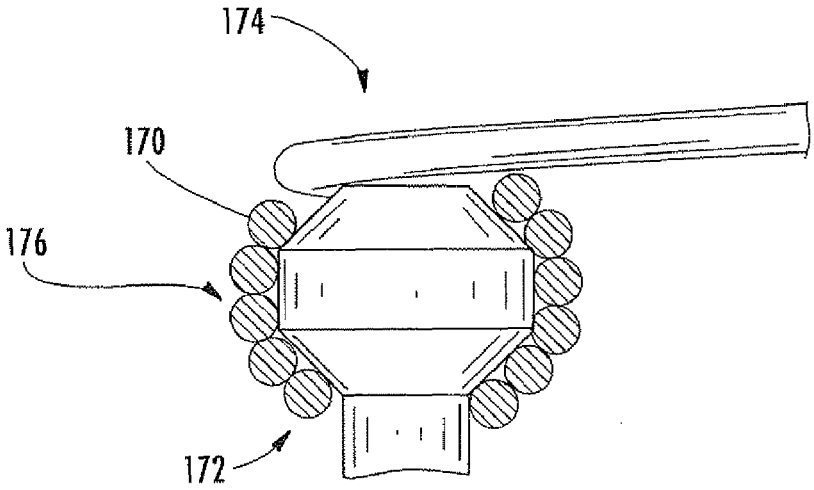
FIGS. 7A, 7B and 7C illustrate cross-sectional views of examples of configurations of a coiled terminal according to the present subject matter.
Figure 7B:
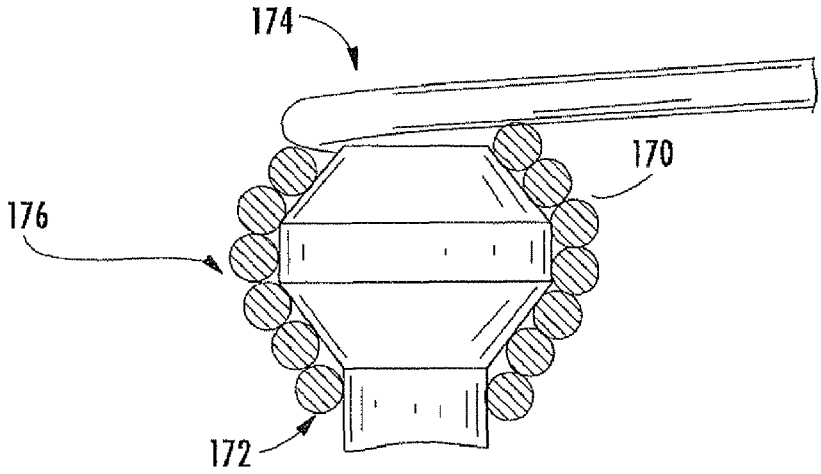
Figure 7C:
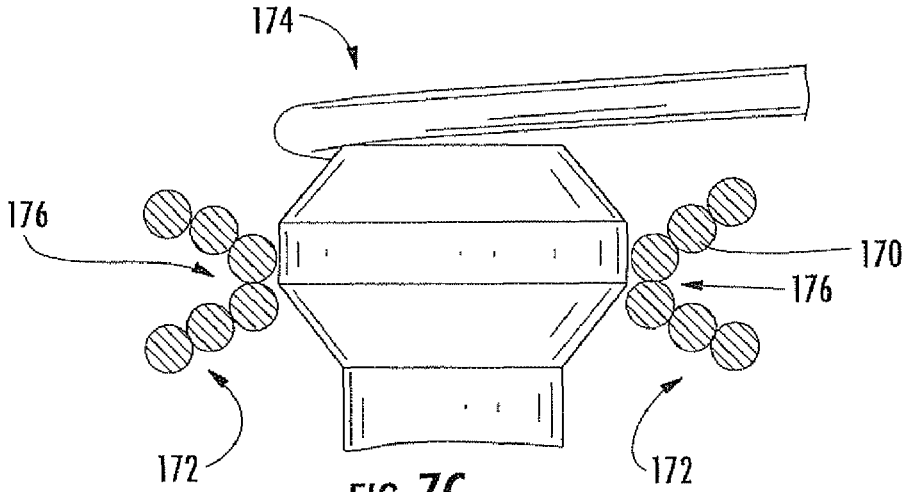

FIGS. 7A, 7B and 7C illustrate cross-sectional views of examples of configurations of a coiled terminal such as coiled terminal 170 according to the present disclosure. It is envisioned that any suitable configuration could exist so long as coiled terminal 170 has an inside or inner area of a varying diameter rather than having a continuous diameter for providing a variable interference fit. In FIG. 7A, coiled terminal 170 is shown in one example with its coils extending to form somewhat of an expanded cylindrical shape with an inner area. First end 172 and second end 174 can have diameters that can be smaller than the diameter of middle portion 176. The coils can extend at least generally along an arc or continuous curve. In FIG. 7B, coiled terminal 170 is shown in another example with its coils extending where they extend similar to the example shown in FIG. 7A but not entirely along a continuous curve. In FIG. 7C, coiled terminal 170 is shown in yet another example with its coils extending where only middle portion 176 is of a smaller diameter than first and second ends 172 and 174. Other configurations are also possible.

Figure 8:
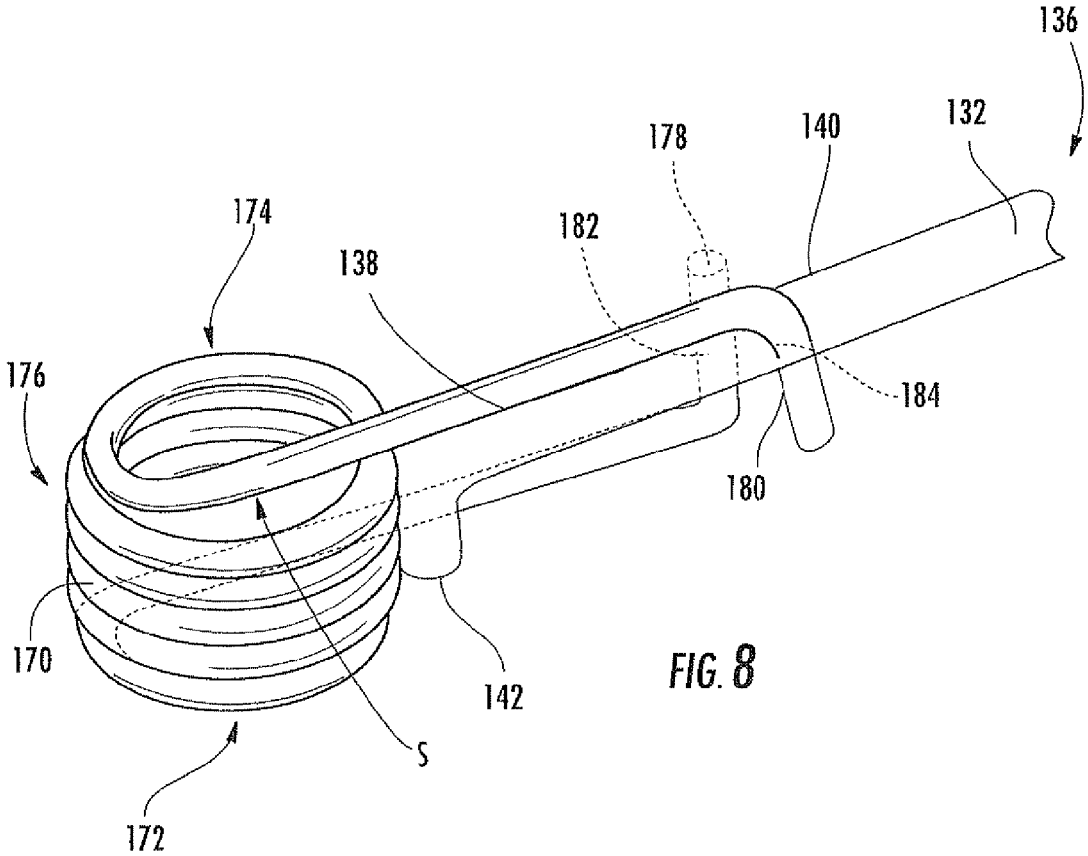
FIG. 8 illustrates a perspective view of another embodiment of a coiled terminal conductively connected with a conductive wire of an ignition cable according to the present subject matter.
Figure 9:
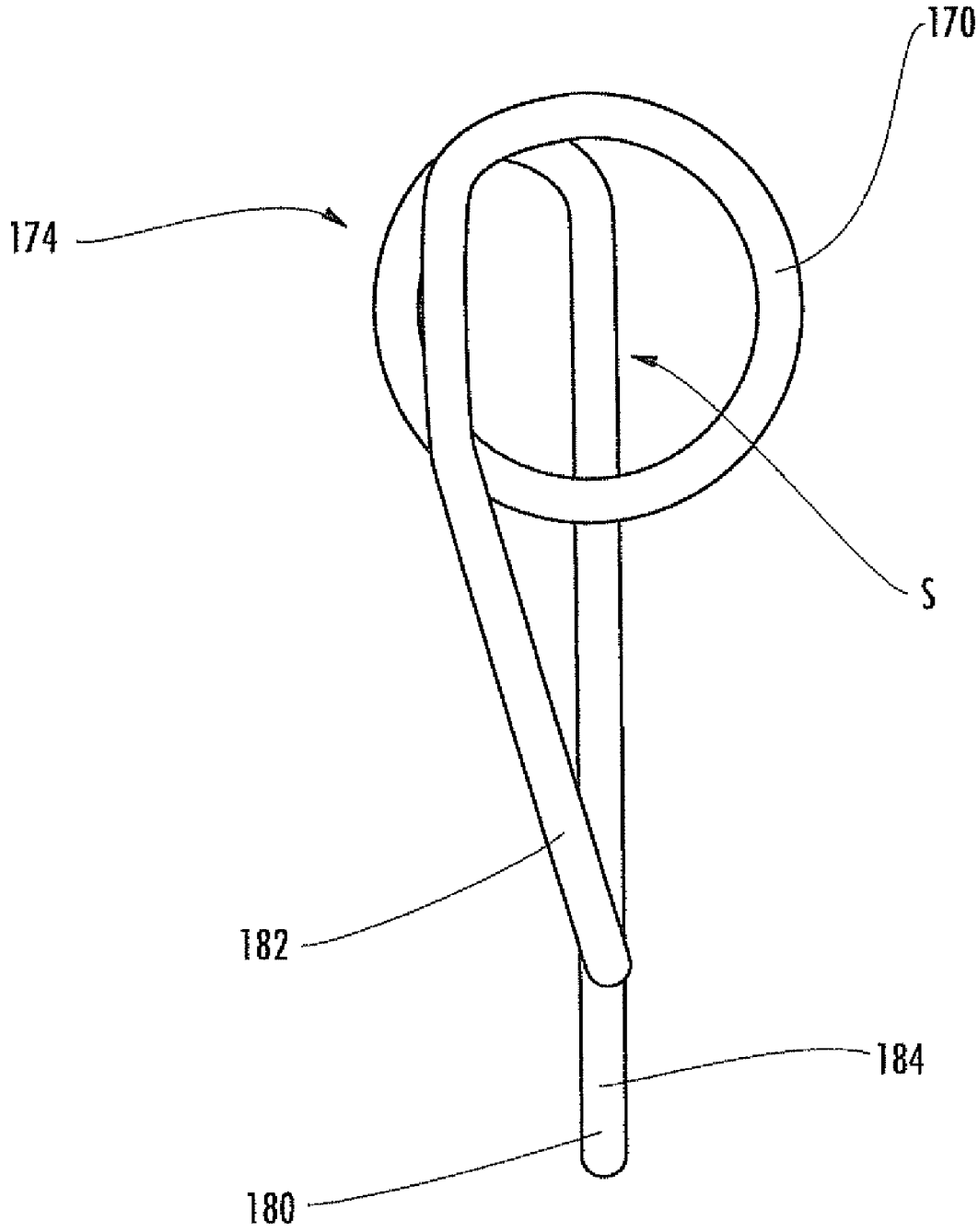
FIG. 9 illustrates a bottom plan view of the coiled terminal according to FIG. 8.

FIGS. 8 and 9 illustrate another embodiment according to the present disclosure. With reference to FIG. 8, coiled terminal 170 can be configured to provide a stop, such as a stop portion generally designated S, that can prevent spark plug terminal 50 (not shown) from extending through second end 174 of coiled terminal 170. Stop portion S can be created when the top coil transverses second end 174 of coiled terminal 170. That is, stop portion S can extend to second conductive contact portion 184 by extending across, the diameter, such as for example by extending centrally across the diameter, of coiled terminal 170 as shown, and as also illustrated in FIG. 9.

With continuing reference to FIG. 8, a detent or variable interference fit can be achieved by configuring the bottom coil at first end 172 of coiled terminal 170 to transverse a portion of first end 172 of coiled terminal 170. That is, the bottom coil that extends to first conductive contact portion 182 can extend across a portion of first end 172 of coiled terminal 170 such that spark plug terminal 50 (not shown) can enter first end 172 and the portion of the bottom coil that transverses first end 172 can provide a detent or variable interference fit to spark plug terminal 50 (not shown), as also illustrated in FIG. 9.

It will be understood that various details of the disclosed subject matter may be changed without departing from the scope of the disclosed subject matter. Furthermore, the foregoing description is for the purpose of illustration only, and not for the purpose of limitation.

What is claimed is:

1. An electrical connector for connecting a voltage source to a spark plug terminal, the connector comprising:

a coiled terminal for conductively connecting with a voltage source, the coiled terminal comprising coils having a first end with a first diameter, a second end with a second diameter, and a middle portion with a middle diameter, the coils extending from the first end to the second end along a curve and defining an inner area for receiving at least a portion of the spark plug terminal, at least a portion of the coiled terminal being deformable to fit around the spark plug terminal;

wherein the first and second diameters of the first and second ends, respectively, of the coiled terminal are smaller than the middle diameter of the middle portion of the coiled terminal; and at least a portion of a bottom coil is configured to extend across a portion of the first end of the coiled terminal and provide a detent feel upon the coiled terminal receiving at least the portion of the spark plug terminal, the detent feel indicating that the coiled terminal is attached to the spark plug terminal.

2. The electrical connector system of claim 1 wherein the coiled terminal further comprises a first conductive contact portion extending from the coiled terminal for contacting the ignition cable.

3. The electrical connector system of claim 2 wherein the coiled terminal further comprises a second conductive contact portion extending from the coiled terminal for contacting the ignition cable.

4. The electrical connector system of claim 1 wherein the coiled terminal is constructed of a substantially bronze material.

5. The electrical connector system of claim 1 wherein the coiled terminal is constructed of a substantially stainless steel material.

6. The electrical connector system of claim 1 wherein the coiled terminal comprises a stop portion configured to extend across a diameter of the coiled terminal.

7. An electrical connector system of claim 1, the system further comprising an ignition cable having a first end for connecting to a voltage source and the ignition cable having a second end conductively connected with the coiled terminal.

8. An electrical connector system of claim 7, the system further comprising a body member having a first end for receiving the spark plug terminal and a second end for receiving the second end of the ignition cable.

9. The electrical connector system of claim 8 wherein the body member is L-shaped.

10. The electrical connector system of claim 8 wherein the body member is constructed of a heat resistant material.

11. The electrical connector system of claim 8 wherein the body member is constructed of a substantially silicon material.

12. A method for conductively connecting a spark plug terminal to an ignition wire for use with an internal combustion engine, the method comprising:

positioning a spark plug boot assembly over the spark plug terminal, the spark plug boot assembly comprising:

an ignition cable comprising a conductive wire within an insulation layer, and the ignition cable having a first end for connecting to a voltage source and a second end;

a body member having a first end for receiving the spark plug terminal and a second end for receiving the second end of the ignition cable;

a coiled terminal for conductively connecting with the ignition cable, the coiled terminal having one or more coils extending to form an inner area for receiving at least a portion of the spark plug terminal, the inner area formed by the coils having a varying diameter for connecting the coiled terminal to the spark plug terminal;

wherein a bottom coil of the coiled terminal forms a first conductive contact with the conductive wire of the ignition cable and a top coil forms a second conductive contact with the conductive wire, and the conductive wire comprises a bend extending beyond the insulation layer such that an outer surface of the conductive wire contacts one or more outer surfaces of the one or more coils forming a third conductive contact where the coils surround the spark plug terminal; and applying force to the spark plug boot assembly in an axial direction of the spark plug terminal to securely attach the spark plug boot assembly to the spark plug terminal, wherein at least a portion of the bottom coil is configured to extend across a portion of a first end of the coiled terminal and provide a clicking sound and a detent feel upon the coiled terminal receiving at least the portion of the spark plug terminal indicating attachment of the spark plug boot assembly to the spark plug terminal.

13. An electrical connector system for connecting a voltage source to a spark plug terminal, the connector comprising:

a coiled terminal for conductively connecting with the voltage source, the coiled terminal comprising coils having a first end with a first diameter, a second end with a second diameter, and a middle portion with a middle diameter, the coils extending from the first end to the second end along a curve and defining an inner area for receiving at least a portion of the spark plug terminal;

a conductive wire connected with the coils and positioned within an insulation layer, the conductive wire extending beyond the insulation layer such that the insulation layer is spaced apart from the coiled terminal a distance approximately equal to a thickness of the conductive wire; and wherein at least one of the first and second diameters of the first and second ends, respectively, of the coiled terminal is smaller than the middle diameter of the middle portion of the coiled terminal for securely connecting the coiled terminal to the spark plug terminal, and wherein the different diameters of the coiled terminal are configured to provide a clicking sound and a detent feel upon the coiled terminal receiving at least the portion of the spark plug terminal, the clicking sound and the detent feel indicating that the coiled terminal is attached to the spark plug terminal.

14. The electrical connector system of claim 13 wherein the coiled terminal further comprises a first conductive contact portion extending from the first end of the coiled terminal for contacting the ignition cable.

15. The electrical connector system of claim 14 wherein the coiled terminal further comprises a second conductive contact portion extending from the second end of the coiled terminal for contacting the ignition cable.

16. The electrical connector system of claim 13 wherein the coiled terminal is constructed of a substantially stainless steel material.

17. The electrical connector system of claim 13, the system further comprising an ignition cable having a first end for connecting to a voltage source and the ignition cable having a second end conductively connected with the coiled terminal.

18. The electrical connector system of claim 17, the system further comprising a body member having a first end for receiving the spark plug terminal and a second end for receiving the second end of the ignition cable.

19. The electrical connector system of claim 18 wherein the body member is L-shaped.

20. The electrical connector system of claim 18 wherein the body member is constructed of a heat resistant material.

21. The electrical connector system of claim 18 wherein the body member is constructed of a substantially silicon material.

22. A spark plug boot assembly comprising:

an ignition cable having a first end for connecting to a voltage source and a second end, the ignition cable comprising a conductive wire having an outer surface and the ignition cable further comprising an insulation layer surrounding the outer surface of the conductive wire;

an L-shaped body member having a first end for receiving a spark plug terminal and a second end for receiving the second end of the ignition cable;

a coiled terminal positioned within the body portion and conductively connected with the ignition cable, the coiled terminal comprising coils having a first end with a first diameter, a second end with a second diameter, and a middle portion with a middle diameter, the coils extending from the first end to the second end along a curve and defining an inner area for receiving at least a portion of the spark plug terminal, where at least a portion of a bottom coil is configured to extend across a portion of the first end of the coiled terminal and provide a detent feel upon the coiled terminal receiving at least the portion of the spark plug terminal, the detent feel indicating that the coiled terminal is attached to the spark plug terminal;

a first conductive contact portion extending from the first end of the coiled terminal and contacting the conductive wire of the ignition cable;

a second conductive contact portion extending from the second end of the coiled terminal and contacting the conductive wire of the ignition cable;

wherein at least one of the first and second diameters of the first and second ends, respectively, of the coiled terminal is smaller than the middle diameter of the middle portion of the coiled terminal for securely connecting the coiled terminal to the spark plug terminal; and further wherein the conductive wire comprises a bend extending beyond the insulation layer such that the outer surface of the conductive wire contacts an outer surface of the coiled terminal.

23. A method for conductively connecting a spark plug terminal to an ignition wire for use with an internal combustion engine, the method comprising:

positioning a spark plug boot assembly over the spark plug terminal, the spark plug boot assembly comprising:

an ignition cable comprising a conductive wire with an insulation layer, and the ignition cable having a first end for connecting to a voltage source and a second end;

a body member having a first end for receiving the spark plug terminal and a second end for receiving the second end of the ignition cable;

a coiled terminal positioned within the body portion and conductively connected with the ignition cable, the coiled terminal having a first end, a second end, and a middle portion, the coiled terminal extending from the first end to the second end along a curve and defining an inner area for receiving at least a portion of the spark plug terminal;

wherein the first and second ends of the coiled terminal vary to have smaller diameters than a diameter of the middle portion of the coiled terminal for securely connecting the coiled terminal to the spark plug terminal; and wherein the conductive wire extends beyond the insulation layer such that the conductive wire contacts an outer surface of the coiled terminal where the coiled terminal is connected to the spark plug terminal; and applying force to the spark plug boot assembly in an axial direction of the spark plug terminal to securely attach the spark plug boot assembly to the spark plug terminal, wherein the variable diameter of the coiled terminal is configured to provide a clicking sound indicating attachment of the spark plug boot assembly to the spark plug terminal.

24. An electrical connector system for connecting a voltage source to a spark plug terminal, the connector comprising:

a coiled terminal for conductively connecting with a voltage source, the coiled terminal comprising coils of a variable diameter, the coils having a first end with a first diameter, a second end with a second diameter, and a middle portion with a middle diameter, the coils extending from the first end to the second end along a curve and defining an inner area for receiving at least a portion of the spark plug terminal, at least a portion of the coiled terminal being deformable to fit around the spark plug terminal and wherein the coils are configured to extend around the spark plug terminal about a central axis and wherein at least one of the first and second diameters of the first and second ends, respectively, of the coiled terminal are smaller than the middle diameter of the middle portion of the coiled terminal; and an ignition cable connected with the coiled terminal, the ignition cable extending in a direction substantially orthogonal to the central axis;

wherein the variable diameter of the coiled terminal is configured to provide a clicking sound upon the coiled terminal receiving at least the portion of the spark plug terminal, the clicking sound indicating that the coiled terminal is attached to the spark plug terminal.

* * * * *